US005492108A

United States Patent [19]

Smith et al.

[11] Patent Number: 5,492,108

[45] Date of Patent: Feb. 20, 1996

[54] VENTILATION SYSTEM FOR PROTECTIVE GARMENTS

[75] Inventors: W. Novis Smith, Philadelphia, Pa.; Gary Frazier, Guntersville, Ala.

[73] Assignee: Lakeland Industries, Inc., Ronkonkoma, N.Y.

[21] Appl. No.: 278,920

[22] Filed: Jul. 21, 1994

Related U.S. Application Data

[63] Continuation-in-part of Ser. No. 27,292, Apr. 27, 1993, abandoned.

[51] Int. Cl.[6] ..... A62B 18/08

[52] U.S. Cl. ..... 128/201.15; 128/201.29

[58] Field of Search ..... 128/201.15, 201.29, 128/202.12

[56] References Cited

U.S. PATENT DOCUMENTS

| | | | |
|---|---|---|---|
| 174,286 | 2/1876 | Ostberg | 128/201.29 |
| 3,043,300 | 7/1962 | Flagg | 128/201.29 |
| 3,667,460 | 6/1972 | Shepard | 128/201.15 |
| 4,458,680 | 7/1984 | Childers et al. | 128/201.29 |

*Primary Examiner*—Aaron J. Lewis
*Attorney, Agent, or Firm*—John Lezdey

[57] ABSTRACT

An improvement in ventilating protective garments used against chemical agents. There is provided an arrangement of the air supply and the air exhaust so that the air cools the occupant and sweeps across the visor of a headpiece to prevent fogging. A regulator is used to maintain a degree of inflation in the garment by the incoming air.

15 Claims, 2 Drawing Sheets

FIG. 3A
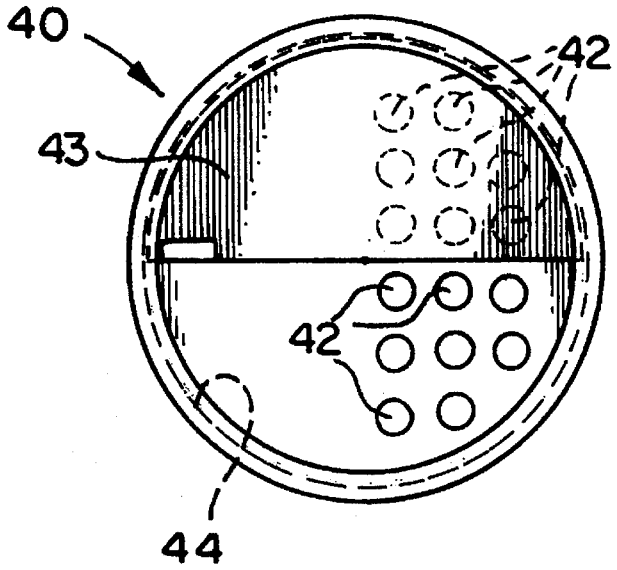
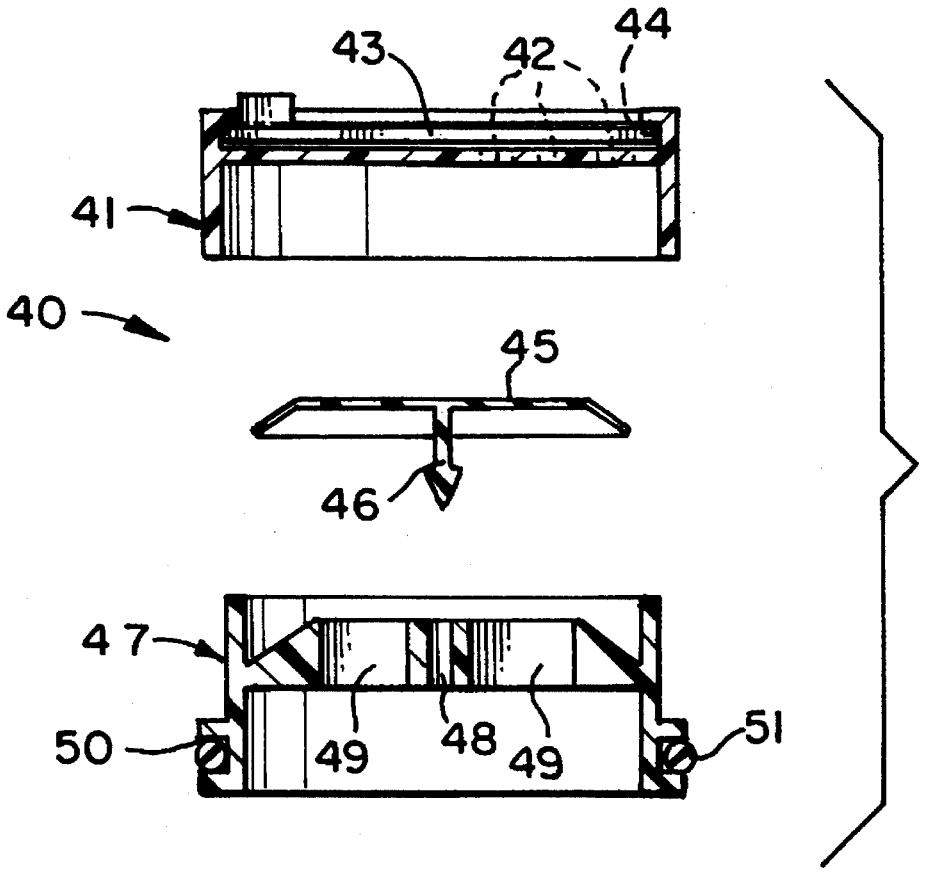
FIG. 3B

VENTILATION SYSTEM FOR PROTECTIVE GARMENTS

RELATED APPLICATIONS

This application is a continuation-in-part of application Ser. No. 08/027,292 filed Apr. 27, 1993 now abandoned.

FIELD OF THE INVENTION

The present invention relates to a system for effectively cooling the occupant of a protective garment and ventilating the garment. More particularly, the invention provides a protective garment which contains an arrangement whereby the occupant is cooled and the visor is substantially fog free. The inflation of the garment is also regulated.

BACKGROUND OF THE INVENTION

Protective clothing of many types is now well known for many and varied uses, such as suits for industrial workers, firemen, forest fire fighters, race car drivers, airplane pilots, and suits for use by military personnel, for protection from fire, vapors and harmful substances. Garments include not only complete, hermetic suits, but also individual garments such as trousers jackets, gloves, boots, hats, head coverings, masks, etc.

Regulations restricting exposure to hazardous environments of various kinds such as the Occupational Safety and Health Act, make it increasingly necessary to have better and more effective kinds of protective garments. In particular, certain requirements by the U.S. Coast Guard and related requirements by other U.S. government or organizations involve a total protective hermetic suit or envelope around the individual person or firemen. These situations involve cleaning up chemical spills or for fighting chemical fires where the chemical materials are unknown and presumed toxic.

The need for such encapsulating suits is for "immediately dangerous to life and health (IDLH)" environments. These suits must be air tight and worn with a self-contained breathing apparatus. The suit must be none absorbent, totally impermeable, and resistant to the widest range of chemicals and reagents. It should also be as fire resistant as possible. Since these suits are being worn by actively working individuals, they should also be flexible, abrasion resistant, lightweight, and should maintain their impermeability while being used.

Such garments presently available are almost invariably of thick construction and heavy in weight, and are often fabricated at least in part from materials impermeable to water or water vapor, such as natural and synthetic rubbers and elastomers, chlorinated rubbers, etc.

Protective clothing comprised of laminates of films have the problem of forming "kinks" when bent so as to restrict movement and become cumbersome.

Protective garments which are also intended to be used in chemical or microbial environments are generally air impervious. The user of the garment because of body heat and from the stress from the work and respiration creates an atmosphere within the protective garment of heat and moisture. The results of the moisture within the headpiece generally causes fogging of the visor which impairs visibility. Even slight fogging of the visor in an external environment containing smoke or clouding can restrict or impair the function of the occupant.

Air into the protective garment is generally provided from a cylinder forming a backpack which supplies the air into the protective garment through the headpiece or through a back portion of the garment. Alternatively, the garment is tethered with a hose from a central supply in which an air hose leads into the headpiece or a back portion. The air supply is intended to provide an internal pressure in the garment to keep it slightly inflated and to cool the occupant. The slight inflation improves the mobility of the occupant as well as permits the air to cool the occupant. The slight inflation is particularly important with garments intended to be used in fire fighting to provide an additional barrier and to prevent adhesion to skin.

Exhaust valves are generally provided to help change the air which is being partially used as well as maintaining a slight pressure within the suit without allowing chemical or smoke seepage through these ports.

For tethered suits, depending on an external air source, it is known to be disadvantageous to be disadvantageous to lead the air into the protective garment through the headpiece. The air hose which is used encumbers movement of the head and any entanglement of the hose can cause removal of the headpiece and subject the occupant to immediate peril. Furthermore, when the air hose is attached to the headpiece the primary area cooled is the head. However, the remainder of the body may not be sufficiently cooled and depending upon the work situation may result in high perspiration which causes discomfort as well as fogging of the visor.

Placement of the air hose on the back portion of the protective garment improves head mobility but reduces the circulation of air across the visor so that visibility can be effected.

Ideally, the air supply into a protective garment should be a able to function to keep the garment slightly inflated to efficiently cool the entire garment and to prevent accumulation of moisture on the inner part of the visor. This should be done with a minimum amount of air flow. Excessive air flow will use up the supply from a portable cylinder too fast, or will require too much flow from an external air pump possibly creating a limited air supply situation.

U.S. Pat. No. 5,082,721 to Smith et al, which is herein incorporated by reference, illustrates a protective garment which can be adapted with the ventilation system of this invention.

SUMMARY OF THE INVENTION

The present invention provides an improvement in protective garment against chemical agents. The garment comprises a headpiece, leg portions and a body portion which forms a crotch with the leg portions and a plurality of exhaust means. The improvement comprises connecting the garment to a source of air supply by at least one hose at the side of the body portion. The garment is provided with a first air exhaust means on the side of the headpiece opposite the hose and a second air exhaust on the leg portion opposite the hose. Under the present arrangement the air supplied to the garment passes across the body of the occupant so as to cool the body and is exhausted through the second exhaust means. The air further passes directly to and across the visor and out of the first exhaust means so as to prevent fogging of the visor. A positive flow of air to the face also provides a psychological advantage to the suit occupant, since he can feel that he is breathing fresh air.

The air flow is regulated so as to be sufficient to keep the visor clear. If high heat and stress are encountered and air supply is limited, then the second exhaust on the leg is reduced by partial capping or adjustment or closed off thereby increasing flow to the first exhaust and across the visor.

Advantageously, the location of the air supply hose is on the side of the body portion of the garment approximately midpoint between the crotch and the arm portion so that the air sweeps along the front and back side. There is an approximate six inch area between the chest line and the back.

Advantageously, the exhaustion of air can be regulated utilizing one way exhaust valves with variable exhaust apertures. The regulation of the exhaustion of air allows the regulation of the degree of inflation of the garment without modifying the air supply. At least two exhaust valves are required but others can also be employed depending upon the particular utility of the garment, preferably 2 to 8.

Accordingly, it is an object of the invention to provide an improvement in the ventilation of protective garments used in the protection against chemical agents and clean up to provide the maximum amount of evaporative cooling of the body with the flow of breathing air.

The problem of heat stress for wearers of fully enclosed protective suits with outside air supply has been a difficult problem to solve. The problem is caused by the lack of evaporation from the skin surface due to the 90-10% heat and humidity built up under stress conditions inside the protective garment. A main means of cooling of perspiration. If the humidity is high this can not occur which is exemplified the formation of water inside the suit and heavy fogging. External means of cooling have been used including circulation of cold water, from an outside portable ice pack.

The present invention can be used along or in conjunction with external cooling. The present invention optimizes the cooling capabilities of a suit without external cooling.

Without any cooling a person can only last 10–15 minutes under conditions of stress in these suits.

It is a further object of the invention to provide for the prevention of fogging of the visor used with protective garments.

It is another object of the invention to provide a method for ventilating protective garments which will prevent fogging of the visor of the headpiece used and which regulates the degree of inflation of the garment.

Other objects and a fuller understanding of the invention will be had by referring to the following description and claims taken in conjunction with the accompanying drawings.

BRIEF DESCRIPTION OF THE DRAWINGS

FIGS. 3A is a top view of a variable air exhaust valve which may be used with the garment of the invention; and FIG. 3B is an exploded side sectional view of the valve of FIG. 3A.

DESCRIPTION OF THE PREFERRED EMBODIMENTS

Figure 1:
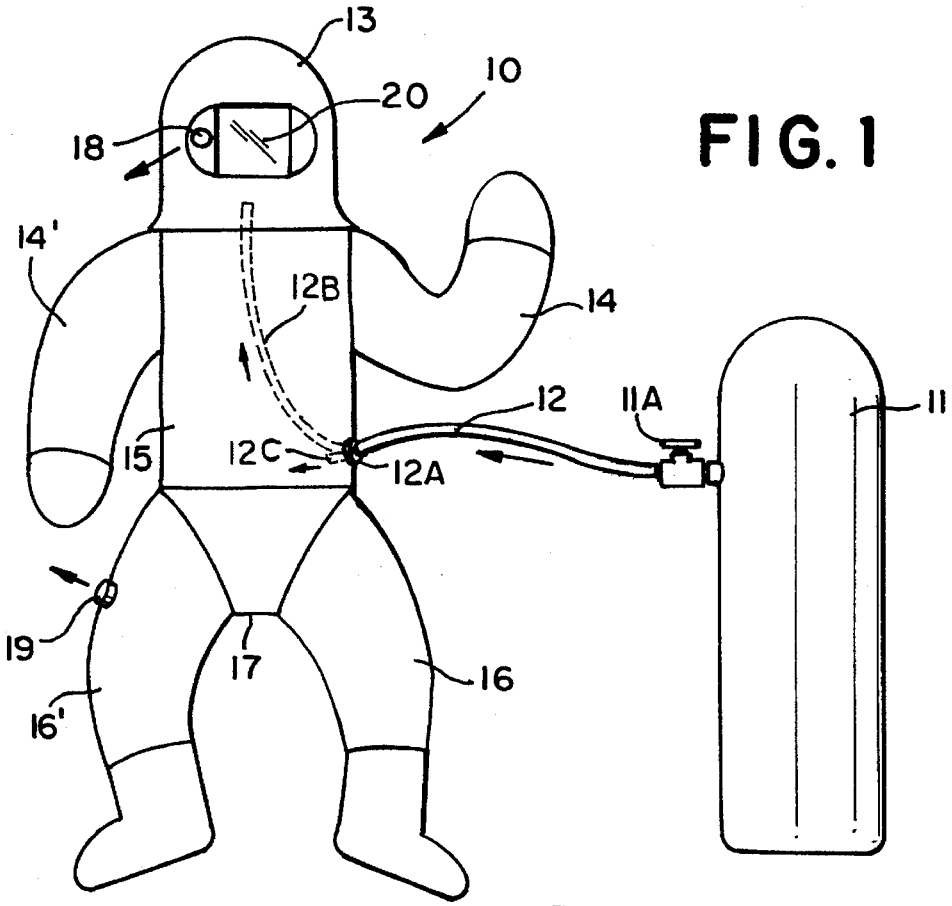
FIG. 1 illustrates a protective garment of the invention connected to a source of air supply.

Although specific terms are used in the following description for the sake of clarity, these terms are intended to refer only to the particular structure of the invention selected for illustration in the drawings, and are not intended to define or limit the scope of the invention.

Figure 2:
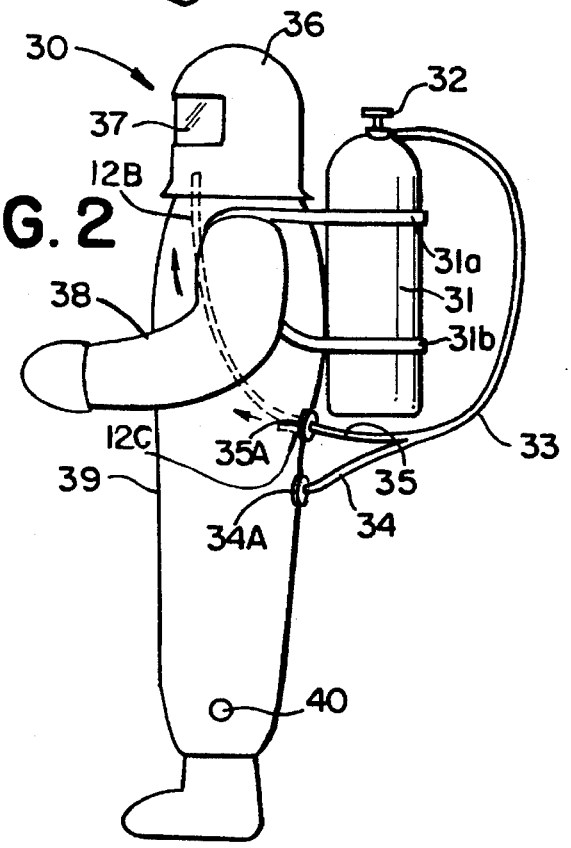
FIG. 2 illustrates the protective garment of the invention wherein the source supply is a backpack.

As seen in FIG. 1, a protective garment is formed with a body portion 15 having a pair of arm portions 14,14' and leg portions 16,16' which in combination with the body portion 15 forms a crotch 17. A headpiece 13 is provided with an optically transparent visor 20. A source of air for ventilating and cooling the occupant comes from an air cylinder 11 through control valves 11A to an air hose 12 that is attached to the side of the garment 10 at point 12A. Advantageously, the air hose 12 is attached to the side of the garment 10 at a location between the crotch portion and arm portion 14 and between the chest and back line. That is on a horizontal line of about six inches between the chest and the back portion defined by line x—x as seen in FIG. 2. Preferably, the attachment is between the hip and arm portion.

On the leg portion 16' which is opposite to the attached hose 12 at location 12A, is placed a one way air exhaust valve 19. At location 12A there is an entry 12C, which sweeps air across the body and a tube 12B, which leads directly to the visor and face to sweep air and keep the visor clear of moisture. Another one way air exhaust valve 18 is placed on the headpiece 13 adjacent the visor 20. The valves 18,19 are placed so that the air which comes from an air supply such as cylinder 12, will sweep across and cool the body and at the same time sweep across the visor to eliminate an fogging which may have occurred as a result of perspiration and respiration. Other exhaust valves may be placed at different parts of the garment, for example, on the back portion. Since the hose 12 is connected at the side of the garment rather than the headpiece, there is greater freedom in moving the head and avoiding loss of the headpiece by entanglement.

If the exhaust valves are placed on the same side and near where fresh low moisture air flow "short circuits" and tends to flow back out of the suit and does not sufficiently and effectively pick-up moisture or provide effective evaporative cooling. This situation would require a much higher air flow rate to accomplish the same amount of evaporate cooling. The increase in air flow in most cases would not be practical.

In the situation where air comes from a portable compressed air cylinder and is breathed through a mouth and face regulator, the respiration and excess air also requires an optimum placement of the exhaust valves. There is not as much an excess of air coming into the garment since the portable air pack must be used much more efficiently than the situation wherein a remote source supplies air. In such a case, one or two exhaust valves is placed to the top of the head toward the front to force air to sweep over the face mask and keep it clear.

Suitable valves are available from Safety Solutions Worthington, OH and sold as exhalation valve 17GF15.

FIG. 2, illustrates the use of a protective garment 30 with the air supply being provided from a backpack. The backpack is formed by an air cylinder 31 which is worn on the back by straps 31*a*,31*b*. A hose 33 is connected to the air control 32 and attached to deliver air into the garment 30 through the body portion 39 at the side. According to an embodiment of the invention the hose 33 has two entries 35 which supplies air at a location 35A to a tube 12B which leads to the face and visor and another entry 34 which supplies air at a location 34A that is located on the side and about the height of the crotch area. As the air enters the garment 30, it sweeps across to exhaust valve 40 as well as the exhaust valves found on the other side of the garment (not shown) on the leg portion opposite valve 40 and arm portion 38. The air further sweeps to the headpiece 36 through tube 12B and across the visor 37 to the exhaust valve (not shown). The air is provided under a pressure to maintain the garment slightly inflated so as to have better maneuverability and to prevent kinking. One to two psi have been found to be sufficient.

FIGS. 3A and 3B illustrate one form of a variable apertured one way valve 40 which may be used in the present invention. The valve 40 comprises a housing 41 having an apertured top 42. A slide cover 43 which is in the form of a half circle which manually rotates within a slot 44 so as to vary the degree of openings for exhaust. A flexible elastomeric disk 45 with a stem 46 is held on the seat 47. The stem 46 is held within the opening 48 of the seat 47. The seat 47 is provided with openings 49 through which air is exhausted in one direction. On the outside of the seat 47 is an O-ring 5 which is within a groove 50. The O-ring 5 forms a seal when placed in a receptacle in the garment. A valve which is adjustable on the suit has been found to be more easy to regulate the degree of inflation than adjusting the controls at the source of the air supply. Full or half cups can be used to close off these valves when necessary. These exhaust can be attached to the valve.

The invention may be embodied in other specific forms without departing from the spirit or essential characteristics thereof. The present embodiments are therefore to be considered illustrative and not restrictive, the scope being indicated by the appended claims rather than by the foregoing description, and all changes that come within the range of equivalency of the claims are therefore intended to be embraced therein.

What is claimed is:

1. In a protective garment against chemicals having a headpiece with a visor, arm portions, leg portions and a body portion having at least one side portion which forms a crotch with the leg portions, contains exhaust means and is connected to a source of air, the improvement which comprises said garment being connected to a source of air supply by at least one hose at the side of the body portion of said garment, said garment having a tube connected to said air supply for supplying air directly to the visor and the face of an occupant and an air inlet to allow air into the garment from said air supply; a first air exhaust means on the side of the headpiece opposite said air supply hose and a second air exhaust on the leg portion opposite said air supply hose means including the first and second exhaust means and their respective positions relative to the air inlet for passing supplied air across the body of an occupant to cool the body of such an occupant and for preventing fogging of the visor.

2. The protective garment of claim 1 wherein said air supply hose is attached to said garment along the side at a location between the crotch portion of said garment and the arm portion of said garment.

3. The protective garment of claim 1 wherein said garment contains two air inlet hoses, one of which hose being connected to the tube supply air to the visor.

4. The protective garment of claim 1 wherein said first air exhaust means is on the side of said visor.

5. The protective garment of claim 1 wherein said first and second air exhaust means comprises a one way valve.

6. The protective garment of claim 5 said first and second air exhaust means further includes means for regulating the degree of exhaust.

7. The protective garment of claim 1 wherein said garment contains more than two air exhaust means.

8. The protective garment of claim 1 wherein said garment contains 2 to 8 exhaust means.

9. The protective garment of claim 1 wherein said second air exhaust means is on the leg portion of the garment between a knee portion and the crotch portion on the opposite side of the air inlet.

10. In a method for ventilating a chemical protective garment comprising the steps of:

providing a headpiece including sides and a visor, arm portions, leg portions, a body portion including side portions and a crotch having leg portions;

providing at least first and second exhaust means on one side of the headpiece and on the the leg portion respectively;

introducing air into the garment through one of the side portions;

providing a tube leading directly to the visor and providing introduced air through said tube leading directly to and across the visor to reduce fogging;

passing introduced air across the body of an occupant to cool such an occupant's body by exhausting air via said first and second exhaust means from positions opposite where air is being introduced.

11. The method of claim 10, providing first and second exhaust means in the form of one way each valves having an exhaust aperture.

12. The method of claim 11 including the step of regulating the size of said exhaust apertures.

13. The method of claim 10 further comprises the step of at least partially inflating the garment by regulating air pressure within the garment.

14. The method of claim 10 further comprising the step of locating the second air exhaust means on a leg portion which is opposite the air inlet and between the crotch portion and the knee portion of the garment.

15. The method of claim 10 further comprising the step of locating the air inlet along the side of the body portion midpoint between the crotch and the arm portion.

* * * * *